US005901767A

United States Patent [19]

Ralton et al.

[11] Patent Number: 5,901,767

[45] Date of Patent: May 11, 1999

[54] PLEATED BLINDS

[75] Inventors: David Ralton; Norman Gordon Matheson; Malcolm James Wootton, all of Scotland, United Kingdom

[73] Assignee: Eclipse Blind Ltd., United Kingdom

[21] Appl. No.: 08/885,130

[22] Filed: Jun. 30, 1997

Related U.S. Application Data

[63] Continuation of application No. 08/513,364, Aug. 10, 1995, abandoned.

[30] Foreign Application Priority Data

Aug. 11, 1994 [GB] United Kingdom ..... 9416228

[51] Int. Cl.[6] ..... A47H 5/00

[52] U.S. Cl. ..... 160/84.04

[58] Field of Search ..... 160/84.04, 84.05, 160/84.01, 84.03, 84.06, 279, 168.1 R, 173 R

[56] References Cited

U.S. PATENT DOCUMENTS

| | | | |
|---|---|---|---|
| 1,321,800 | 11/1919 | Andress et al. | 160/84.01 |
| 2,320,852 | 6/1943 | De Falco | 160/84 |
| 4,501,311 | 2/1985 | Folland | 160/84.01 X |
| 4,544,011 | 10/1985 | Sawamura | 160/84.04 |
| 4,880,044 | 11/1989 | Judkins | 160/84.04 |
| 4,884,612 | 12/1989 | Schnebly et al. | 160/84.04 |
| 4,974,656 | 12/1990 | Judkins | 160/84.1 |
| 5,184,659 | 2/1993 | Alcocer | 160/84.1 |
| 5,273,097 | 12/1993 | Siegler | 160/84.1 R |
| 5,375,642 | 12/1994 | Gaber et al. | 160/168.1 R |

FOREIGN PATENT DOCUMENTS

| | | | |
|---|---|---|---|
| 0 683 301 A1 | 5/1994 | European Pat. Off. . | |
| 2 261 691 | 5/1993 | United Kingdom . | |
| 2 270 946 | 3/1994 | United Kingdom . | |
| PCT/US89/02491 | 12/1989 | WIPO | A47H 5/00 |
| WO 89/12415 | 12/1989 | WIPO . | |
| PCT/US91/02257 | 10/1991 | WIPO . | |

*Primary Examiner*—David M. Purol
*Attorney, Agent, or Firm*—Fish & Richardson P.C.

[57] ABSTRACT

A pleated blind 20 is disclosed including a head rail 22, a bottom rail 24 and an expandable and collapsible shade 28 extending between them and divided up into a plurality of pleats 30 by fold lines 32. A row of apertures 42 passes through each pleat 30 to permit passage of a supporting cord 10. The supporting cord 10 consists of a central yarn 12 and a series of equally spaced polymeric rungs 14. The rungs 14 are spaced at equal intervals along the cord 10, the spacing between the rungs 14 being substantially equal to the maximum distance between the head rail 22 and the bottom rail 24 divided by the number of pleats 30 in the shade 28. In this way, the rungs 14, which are of sufficient length to span the sides of the apertures 42, will support their respective pleats 30 and prevent the pleats from opening up too widely, thus ensuring that the pleat spacing remains substantially even.

8 Claims, 2 Drawing Sheets

PLEATED BLINDS

This is a continuation of application Ser. No. 08/513,364 filed Aug. 10, 1995, now abandoned.

FIELD OF THE INVENTION

This invention relates to pleated blinds of the type consisting of a head rail and a pleated shade adapted to be suspended from the head rail. The invention also relates to methods of manufacturing such blinds and tools for use in the manufacture of such blinds.

TECHNOLOGICAL BACKGROUND

Pleated blinds usually consist of a head rail and a bottom rail and one or more cords which are used to raise or lower the bottom rail with respect to the head rail. An expandable and collapsible pleated shade is arranged between the head rail and the bottom rail so as to expand or collapse along predetermined fold lines when the bottom rail is raised or lowered. The predetermined fold lines usually lie parallel to the head rail and bottom rail. The pleats of the shade are usually manufactured to be equal size within normal manufacturing tolerances.

During normal use of the blind, each pleat carries the cumulative weight of every pleat beneath it, other than those which are resting on the bottom rail. The greater the vertical dimension of the blind, the greater the weight that the higher pleats carry. A consequence of this is that the uniform appearance of equally spaced pleats is lost, because the load on each pleat causes the pleat to creep and open up the angle of its fold. Eventually, the apparent distance between pleats is noticeably greater at the top of the blind than it is at the bottom. The blind can be described as "sagging". For free hanging blinds installed vertically to rectangular windows, this sagging effect does little more than alter the appearance of the blind as described. However, an increasingly popular use for pleated blinds is in conservatory roofs, many of the window shapes of which are not rectangular. The problem of sagging of, for example, a triangular blind manifests itself as a progressively curving and tapering gap between the edge of the blind and the window frame. In these circumstances, the blind is no longer covering the whole of the window area and this is clearly undesirable.

The problem of blind sagging has been addressed and it is known to take remedial steps by mechanically fixing the pleats in their desired position. This is often done by supporting them from above. The simplest way of achieving this is to sew a very fine thread or monofilament from pleat to pleat, ensuring that the length of thread of monofilament between adjacent pleats is uniform. However, this method is a very slow and labour intensive one.

Another method which has been proposed involves attaching a light ribbon to the back of equally spaced pleats, pleat by pleat, by use of what is known as a "Kimble tag" and gun. Kimble tags are commonly used to attach labels to clothes. The disadvantage of this method is that the entire blind has to be spread out on a rigid corrugated former made, for example, from 90° angle aluminium. This pre-spaces the pleats before the ribbon is attached. This is both space and time consuming.

A third method involves passing a cord from the head rail to the bottom rail through apertures in each of the pleats—this being done commonly to maintain the blind in the desired vertical plane—and then to provide a second cord running down the back of the shade and provided with loops at regular intervals. The cord which passes through apertures in the pleats also passes through the loops of the second cord and these loops prevent their respective pleats from sagging beyond a pre-determined position. Again, the manufacture of this type of blind is time consuming and costly in terms of labour.

SUMMARY OF THE INVENTION

The present invention seeks to provide a pleated blind in which the problem of sagging is addressed, but which may be manufactured in a time and labour efficient way.

Thus, the present invention provides a pleated blind comprising a head rail, a pleated shade adapted to be suspended from the head rail and a supporting cord provided at intervals with integral support fixtures and adapted to be attached at one end to the head rail and to pass through a plurality of the pleats of the shade such that each support fixture is adapted to support a respective pleat of the shade.

A pleated blind in accordance with the present invention is simple and cost effective to manufacture because the support function is provided in full by the supporting cord and its integral support fixtures and because the supporting cord, while passing through a plurality of the pleats, is not required to be attached to any of them. In the simplest possible terms, the blind is manufactured by passing the supporting cord through the pleats of the shade so as to ensure that the support fixtures are correctly arranged between the pleats.

Preferably, the support fixtures comprise rungs set substantially perpendicular to the cord. The rungs may be formed from plastics, in which case the cord may be moulded into the rungs. Preferably, the rungs are formed as T-bars.

It is self-evident that in most cases the support fixtures should be equidistant from one another along the cord, but there may be circumstances in which this is not the case. As is common, the blind preferably additionally comprises a bottom rail adapted to be suspended from the shade.

To ensure that each pleat of the shade is supported, it is preferred that the number of support fixtures differs from the number of pleats in the shade by at most one.

The present invention also extends to a method of manufacturing a pleated blind comprising placing a supporting cord provided at intervals with integral support fixtures within a guide tube, inserting the guide tube through a plurality of pleats of a pleated shade and withdrawing the supporting cord from the guide tube and the guide tube from the pleats so as to position the support fixtures between the pleats, each support fixture being adapted to support a respective pleat of the shade.

The use of a guide tube to facilitate the positioning of the support fixtures simplifies the assembly process. Naturally, the support fixtures will in most circumstances be larger than the apertures in the pleats through which the supporting cord passes and the use of a guide tube disposes of problems which would otherwise exist in threading the support fixtures through the apertures. Where the support fixtures comprise rungs set substantially perpendicular to the cord, it is preferred that the internal diameter of the guide tube be smaller than the length of the rungs.

Preferably, placing the cord within the guide tube involves passing one end of the cord into one end of and through the guide tube and pulling on that end of the cord or the guide tube or both so as to pass further lengths of the cord into the guide tube. To facilitate this, the guide tube preferably includes a tool provided at the said one end which is adapted to cause the rungs to rotate with respect to the cord so as to lie at an angle of less than 900 with respect to the cord as the cord is pulled through the guide tube. It is preferred that the tool be adapted to cause the rungs to be substantially aligned with the cord as the cord is pulled through the guide tube.

To facilitate the assembly process, it is preferred that the guide tube be withdrawn from the pleat in the opposite direction from that of its initial insertion; it is likewise preferred that the cord be withdrawn from the guide tube in the same direction as that of insertion into the guide tube.

Each support fixture may be positioned by placing the end of the guide tube from which the cord is withdrawn between adjacent pleats, withdrawing a sufficient length of cord from that end that a support fixture emerges from it and withdrawing the guide tube from between those adjacent pleats. Withdrawing the guide tube from between adjacent pleats may comprise flipping one of more pleats off the end of the guide tube. Preferably, the pleats through which the guide tube passes lie perpendicular to it and those which have been flipped off its end lie parallel to it.

Again, to ensure that most or all of the pleats are supported in the finished product it is preferred that in respect of a major portion of the shade, at least one support fixture be positioned between each pair of adjacent pleats.

Finally, the present invention further extends to a tool for use in inserting within a guide tube a supporting cord provided at intervals with integral rungs set substantially perpendicular to the cord, the tool including means for rotating the rungs with respect to the cord as the cord is pulled through the tool, so as to lie at an angle of less than 90° with respect to the cord. The advantages of such a tool will be self-evident from the description given above of the method according to the invention.

The tool preferably comprises an alignment aperture for aligning the rungs in a predetermined plane as they are pulled into the tool. The alignment aperture is then preferably followed by a shoulder portion which is adapted to retard motion of one end of the rung as the cord is pulled through the tool and thus to cause the rung to rotate so as to lie at an angle of less than 90° with respect to the cord.

To enable the dimensions of the guide tube to be minimised, it is preferred that the means for rotating the rungs causes the rungs to become substantially aligned with the cord as the cord is pulled through the tool. This may be achieved by providing a taper following the shoulder portion, the taper being adapted substantially to align the rotated rung with the cord.

BRIEF DESCRIPTION OF THE DRAWINGS

The present invention will now be described by way of example with reference to the accompanying drawings.

DETAILED DESCRIPTION OF THE DRAWINGS

Figure 1A:
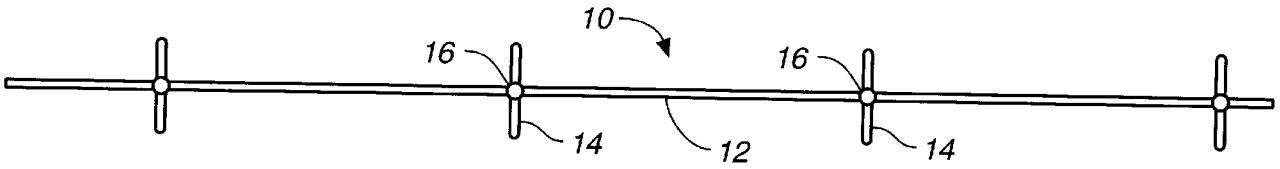
FIG. 1*a* illustrates a supporting cord for use in the present invention.
Figure 1B:
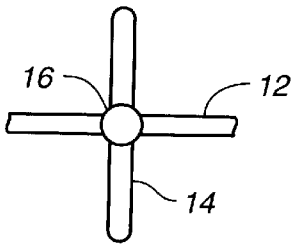
FIGS. 1*b* and 1*c* illustrate the support fixture of the cord of FIG. 1 in greater detail, FIG. 1*b* being a view from the same direction as FIG. 1*a* and FIG. 1*c* being a view from a direction at right angles.
Figure 1C:
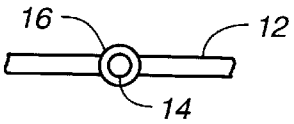

FIGS. 1*a* and 1*b* illustrates a supporting cord 10 consisting of a central filament or twisted or braided yarn 12 and a series of equally spaced supporting fixtures 14. A polyester braided yarn 12 has been found to work satisfactorily. The support fixtures 14 consist of thermoplastic or other rigid polymeric rungs 14 arranged at right angles to the yarn 12. The rungs 14 each include a central enlargement 16, the purpose of which is securely to fix the rungs 14 to the yarn 12. The rungs 14 are attached to the yarn 12 by being moulded around it, with the fused polymer forming the central enlargement 16 flowing around the filaments in the yarn 12 and into the interstices between them. This allows for very secure attachment. The materials choice and dimensions will be selected to represent a compromise between low stretch, low cost, invisibility, creep resistance, handling and adhesion.

Figure 2:
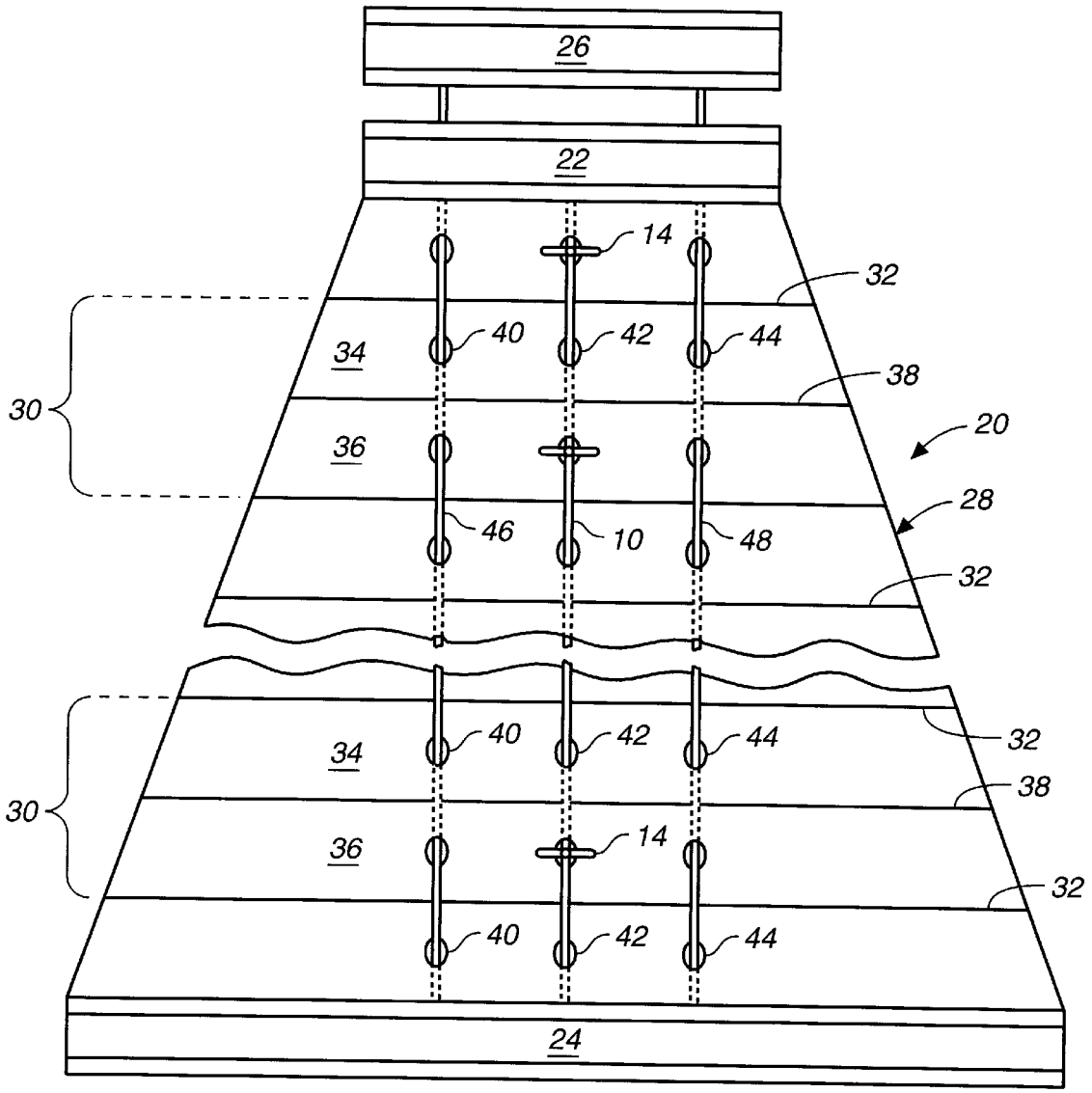
FIG. 2 shows a triangular pleated blind according to the invention.

FIG. 2 shows a triangular, or strictly trapezial, pleated blind 20, such as might be found installed in conservatory roofs. The blind includes a head rail 22 and a bottom rail 24. Unusually, in the blind illustrated, the head rail 22 is movable and the bottom rail 24 is fixed. The head rail 22 moves between the bottom rail 24 and a fixed upper rail 26. Extending between the head rail 22 and the bottom rail 24 and attached to both by suitable means is an expandable and collapsible shade 28, divided up into a plurality of pleats 30 by fold lines 32. Each pleat 30 is subdivided into two parts 34, 36 by means of another fold line 38. The pleat-delimiting fold lines 32 point into the plane of the paper whereas the subdividing fold lines 38 point out of the plane of the paper.

Three rows of apertures 40, 42, 44 pass through each part 34, 36 of each pleat 30. The two outermost rows of apertures 40, 44 are present to permit passage of the blind-raising and lowering cords 46, 48, these cords also serving to keep the head rail 22 and the shade 28 substantially in the plane defined by the upper rail 26 and the bottom rail 24. The middle row of apertures 42 is present to permit passage of the supporting cord 10.

As can clearly be seen from FIG. 2, the rungs 14 are spaced at equal intervals along the cord 10, the spacing between the rungs 14 being substantially equal to the maximum distance between the head rail 22 and the bottom rail 24 divided by the number of pleats 30 in the shade 28. In this way, the rungs 14, which are of sufficient length to span the sides of the apertures 42, will support their respective pleats 30 and prevent the pleats from opening up too widely, thus ensuring that the pleat spacing remains substantially even. As shown in FIG. 2, the rungs support the lower part 36 of each pleat 30, but this need not be so. The upper part 34 could equally well be supported.

The upper and lower ends of the supporting cord 10 are affixed to the head rail 22 and the bottom rail 24 respectively by any suitable means, for example by clamping.

Figure 3A:
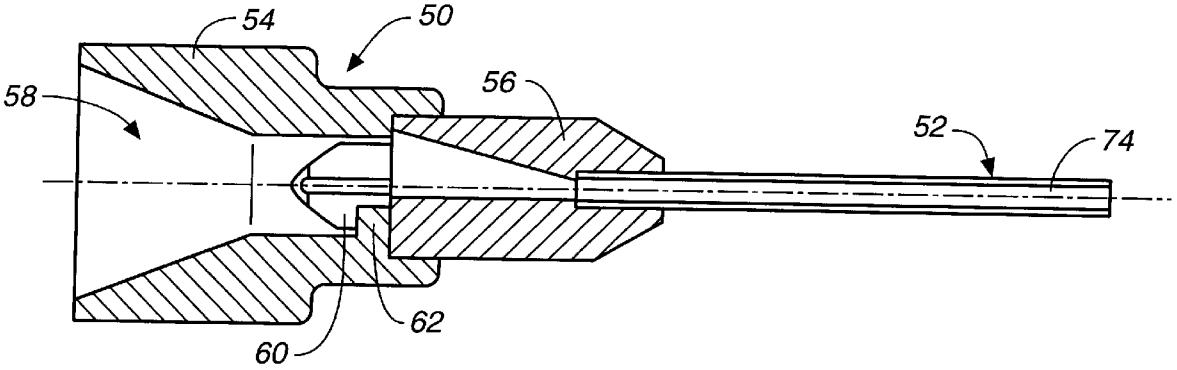
FIGS. 3*a* and 3*b* show a cord-installation tool and guide tube according to the invention.
Figure 3B:
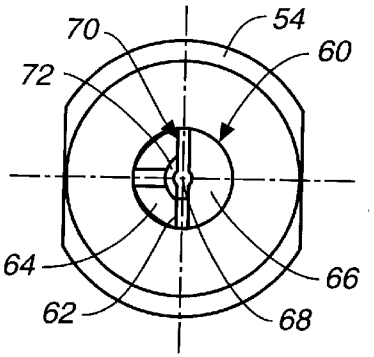

FIG. 3 illustrates a cord installation tool 50 and guide tube 52, the full purpose of which will become apparent from the description below of the method of manufacturing the blind of FIG. 2. The tool 50 can essentially be divided into two parts: an alignment part 54 and a tapered part 56 running between the alignment part 54 and the guide tube 52. The alignment part 54 has a mouth 58, tapering down to an alignment anvil 60 and a shoulder 62. The alignment anvil 60 is in two parts 64, 66, defining between them a central cord-receiving aperture 68 and a rung-receiving slot 70.

To use the tool, one inserts the filament or yarn 12 of the cord between the two anvil parts 64, 66 and into and through the guide tube 52. As the end of the yarn 12 is pulled through the tube, a chamfered surface 72 on one anvil half 64 aligns an incoming rung 14 with the rung-receiving slot between the anvil halves 64, 66. Pulling the yarn further eventually causes one end of the incoming rung 14 to reach the shoulder 62 of the alignment part 54, which brings the movement of that end of the rung 14 to an end.

Further movement of the yarn 12 therefore causes the rung 14 to rotate with respect to the yarn 12, since any additional movement of the end of the rung 14 which has met the shoulder 62 is prevented. The other end of the rung 14 therefore advances at this stage faster than the yarn 12 and the rung 14 enters the tapered portion 56 of the tool 50 with one end of the rung 14 leading the other. The taper of the tapered portion 56 causes the rung 14 to become gradually more and more aligned with the yarn until, when the two enter the relatively narrow bore 74 of the guide tube 52, the rung 14 and the yarn 12 are substantially aligned. The bore 74 of the guide tube 52 is much smaller than the length of the rungs 14.

In this way, a desired length of cord 10 may be loaded into the guide tube 52 ready for installation in a pleated shade as follows. A shade 28 is coated and pleated to form a stack of pleats 30 and then prepared by cutting to whatever shape is desired for the blind 20 in question. Next, a hole of , say, 3 mm diameter is drilled through the stack of pleats 30, ready to receive the supporting cord 10. The stack of pleats is held against a vertical fixture. That vertical fixture possesses a slot or hole through which a pre-loaded guide tube 52, tool 50 attached, is passed so as to pass through the hole drilled through the stack of pleats 30. The pleats lie perpendicular to the guide tube.

The cord is pulled through and out of the guide tube 52 until a rung 14 emerges. As it emerges, the rung 14 will take up its rest position at 90 degrees to the yarn 12 and, being sufficiently long to span the drilled apertures 42 cannot inadvertently be pulled back through the apertures 42. Once one rung 14 has emerged, one pleat 30 from the stack is flipped over away from the vertical fixture so as to lie against a horizontal surface, such as a table.

As the pleats are flipped over, they will stack up on the horizontal surface. This may interfere with the cord installation process if twenty or thirty pleats are stacked upon one another, but this can be solved by opening up the latest couple of pleats to be flipped over and thus moving the stack of pleats away from the vertical fixture.

By proceeding in this way, one can install the cord in the shade with one rung between each pair of adjacent pleats. The time and labour costs of this method as compared with existing blind sag prevention techniques are substantial. For extremely wide blinds 20, it may be preferable to install two support cords 10 spaced from one another, but it has been found that for most blinds 20, just a single cord 10 is sufficient.

We claim:

1. A pleated blind comprising:

a head rail, a pleated shade adapted to be suspended from the head rail and a supporting cord provided at intervals with integral support fixtures and adapted to be attached at one end to the head rail and to pass through a plurality of the pleats of the shade such that each support fixture is adapted to support a respective pleat of the shade; and such that the support fixture comprise rungs normally set substantially perpendicular to the cord, but which can be twisted around to lie parallel to the cord to allow the cord to pass through the pleats.

2. A blind according to claim 1 in which the rungs are formed plastics.

3. A blind according to claim 1 or claim 2 in which the rungs are moulded onto the cord.

4. A blind according to claim 1 in which the rungs are formed as T-bars.

5. A blind according to claim 1 in which the support fixtures are equidistant from one another along the cord.

6. A blind according to claim 1 in which the blind additionally comprises a bottom rail adapted to be suspended from the shade.

7. A blind according to claim 1 in which the pleated shade is suspended from the head rail and the supporting cord is attached at one end to the head rail and passes through a plurality of the pleats of the shade.

8. A blind according to claim 7 in which the number of support fixtures differs from the number of pleats in the shade by at most one.

* * * * *